US005487194A

United States Patent [19]

Kightlinger

[11] Patent Number: 5,487,194

[45] Date of Patent: Jan. 30, 1996

[54] DEVICE TO RESTORE WATER LEVEL IN TOILET BOWL

[76] Inventor: Paul E. Kightlinger, 8410 E. Rolling Ridge, Tucson, Ariz. 85710

[21] Appl. No.: 203,227

[22] Filed: Feb. 28, 1994

[51] Int. Cl.[6] ..... E03D 1/00

[52] U.S. Cl. ..... 4/415; 4/325

[58] Field of Search ..... 4/324, 325, 345, 4/370, 374, 415

[56] References Cited

U.S. PATENT DOCUMENTS

| | | | |
|---|---|---|---|
| 2,320,132 | 5/1943 | Hoffmann | 4/374 X |
| 3,894,299 | 7/1975 | Cleary | 4/326 |
| 3,994,029 | 11/1976 | Badders | 4/407 X |
| 4,017,914 | 4/1977 | Young, Sr. | 4/345 X |
| 4,175,296 | 11/1979 | Goldman | 4/325 |
| 4,225,987 | 10/1980 | Goldman | 4/325 |
| 4,429,423 | 2/1984 | Syrenne | 4/415 X |

*Primary Examiner*—Robert M. Fetsuga

*Attorney, Agent, or Firm*—J. Michael McClanahan

[57] ABSTRACT

A device to restore the water level in a toilet bowl is disclosed wherein bleed water issued by the float actuated valve in a toilet tank reservoir is used to prime a syphon tube so that additional water from the toilet tank reservoir is shuttled down the overflow pipe to the toilet bowl to restore the toilet bowl water level during shortened partial flush operations of the toilet. The syphon tube consists of an inverted "U" shaped tube having one leg situated interiorly the overflow pipe and the other leg reaching down into the water of the toilet tank. The syphon tube operation is commenced by the bleed water injected into the base of the syphon tube through an initiator tube intersecting the syphon tube base so as to direct bleed water into the leg residing in the overflow pipe. An air vent opening situated in the initiator tube is effectively covered by water running through the initiator tube so no air is permitted to enter the syphon tube to disrupt the syphon operation. When the bleed water is terminated, air enters the base of the syphon tube and terminates the syphon action. Thus, sufficient water is conveyed to the toilet bowl to restore the pre-flush water level.

2 Claims, 2 Drawing Sheets

DEVICE TO RESTORE WATER LEVEL IN TOILET BOWL

BACKGROUND OF THE INVENTION

1. Field of the Invention

The field of the invention is devices utilized in toilet water reservoir tanks which enhance the flow of water into the toilet bowl following a full or partial flush of the toilet to assure the proper standing water level exists in the bowl for the next flush.

2. Description of the Related Art

Inasmuch as many parts of the United States, and especially the West and the Southwest regions, experience water supply shortages, it has now become very popular to conserve water by reducing water usage. To this end, the toilets found in residences and businesses are being modified to provide for a smaller flush, i.e., the water reservoir tank is being reduced from a five gallon water capacity to a two to three gallon capacity. In addition, many devices and inventions are coming forth which permit the user to effect a partial or "mini" flush of the older larger capacity type toilets wherein only a portion of the water held in the reservoir tank is utilized for the flush. Experience tends to indicate that a partial flush operates satisfactory for liquid wastes, however, in most cases, a partial or "mini" flush is not always satisfactory to remove solid wastes. Accordingly, many of the devices which provide for a partial or "mini" flush also provide for a full flush, the choice being made by the operator at the time of use.

One such device is shown in my prior United States Patent, namely U.S. Pat. No. 5,228,144 entitled Water Saving Device for Toilets. This invention permits selective manipulation of the toilet tank handle to permit a portion of the water contained in the reservoir tank to exit the toilet tank for a partial or "mini" flush or, to permit all the water of the toilet tank to exit into the toilet bowl for a full flush. The partial or "mini" flush is accomplished by re-seating the flapper valve upon the valve seat after a specified volume of water has drained from the water tank.

Once the flapper valve has re-seated on the valve seat and terminated the flow of water, the reservoir tank begins to refill by means of a float actuated valve. The float attached to the valve rises with the water in the tank until the water reaches its full level at which time the valve closes.

In the operation of a standard toilet, and specifically in the area of the toilet bowl, when the toilet handle is depressed, water from the tank reservoir floods the bowl and initiates the syphon action of the toilet, removing water, and liquid and solid wastes from the bowl. However, the syphon mechanism is so efficient that insufficient water is left in the toilet bowl to begin the next operation. Accordingly, the water level in the bowl must first be brought up to the pre-flush standing level. The float actuated valve is so constructed that a portion of the water filling the toilet tank is bled from the valve to an overflow tube rising vertically in the toilet tank to a height above the full water level. This bleed water from the float actuated valve is conveyed to the open end top of the overflow pipe by means of a flexible tube. The overflow pipe leads directly into the toilet bowl bypassing the flapper valve seated on the valve seat.

The overflow pipe serves two functions, the first is for safety reasons, to drain excess water from the tank to the toilet bowl in the event that the float actuated valve malfunctions and does not shut off when the incoming water reaches a specified height. By this means, water is drained into the bowl of the toilet rather than overflowing the reservoir tank and onto the floor of the bathroom. The second function of the overflow pipe is to receive the water from the float actuated valve via the flexible tubing in order to bring the water level in the bowl up to its proper pre-flush level.

When the float actuated valve terminates the water flowing into the tank, it also terminates the bleed water which is conveyed to the overflow pipe. In the usual full flush toilet mechanisms, the float actuated valve operates sufficiently long bringing fresh water into the tank so that sufficient water flows into the toilet bowl to bring the toilet bowl up to its pre-flush level. If more water than is necessary to accomplish the task is delivered into the toilet bowl, this extra water exits the toilet bowl into the toilet drain.

One problem with partial flush mechanisms is that since only a portion of the water in the toilet tank is removed during a partial flush, the float actuated valve is operating only for the time necessary to bring the water level in the toilet reservoir tank up to its pre-flush level. This is always a shorter time then it takes to completely refill the toilet tank. As a consequence, less water is ultimately conveyed from the float actuated valve to the toilet bowl than is the case for a full flush, resulting in a less than full standing water level in the toilet bowl. As a further consequence, when the toilet is flushed again following a partial flush, a portion of the water first entering the toilet bowl is used to bring the water level in the toilet bowl up to its necessary pre-flush level before the following incoming water will start the toilet operating its syphon action to flush the contents of the toilet out. This being so, in some cases it may be necessary to follow a partial flush with a full flush, even though a full flush may not otherwise be needed, just because the prior partial flush was not sufficient to completely flush the wastes away.

Accordingly, it is readily apparent that at least a portion of the benefits of the "mini" or partial flush operations of a toilet are being obviated.

In view of the foregoing, it is apparent that it would be useful to provide a simple device which provides for restoring the water level of the toilet bowl to the pre-flush level following the operation of the toilet in a "mini" or partial flush mode.

SUMMARY OF THE INVENTION

The embodiment of the invention described consists of a syphon device used to restore the water level in a toilet bowl, especially in those situations where less than a full reservoir tank of water is used to flush the toilet.

The subject invention utilizes bleed water issuing from the float actuated valve to prime a syphon operation wherein water is taken from the toilet tank reservoir and directed into the overflow pipe so that the toilet bowl will receive both the bleed water from the float actuated valve plus water syphoned from the toilet tank itself. The increased water flow to the toilet bowl assures that the water level in the toilet bowl will reach its pre-flush standing level during the fill time of the toilet tank, especially for those shortened times utilizing the toilet in a "mini" or partial flush mode.

Such a goal is accomplished by the inventive use of a modified "U" shaped syphon device. More particularly, the subject invention comprises a two legged "U" shaped hollow tube having two open ends, one leg of which adapted to extend into the reservoir tank to a depth below that maximum depth which the water level will fall when the toilet is in the "mini" or partial flush mode. The other leg of the "U" shaped syphon device is adapted to reside interiorly to the overflow pipe. In use, the subject syphon tube is inverted within the toilet tank with the one leg protruding down the overflow pipe and the other leg into the water of the tank. The half round base portion of the syphon tube rests on the upper circular edge of the overflow pipe.

Connected to the syphon tube at the rounded base of the syphon tube is a hollow initiator tube, the interior of the initiator tube in communication with the interior of the syphon tube. The initiator tube is so oriented to the syphon tube that the rushing water incoming through the initiator tube naturally flows down the leg of the syphon tube protruding into the overflow pipe. The initiator tube connects to one end of the flexible plastic tubing, the other end of which connects to the bleed outlet of the float actuated valve.

Lastly, on the top surface of the initiator tube (when the "U" shaped syphon tube is inverted) is an opening by which air can enter the rounded base of the syphon tube. This air vent opening is so located that it is not covered by the flexible tubing attached to the initiator tube, nor is the air vent opening situated in the syphon tube itself.

The subject invention operates as follows. When the toilet is in its re-filling mode, bleed water issuing from the float actuated valve passes through the flexible tubing into the initiator tube of the syphon device. This water, running out the leg of the syphon tube interiorly to the overflow pipe, primes the syphon tube to pull water from the toilet tank via the other leg dipping down into the reservoir tank and then into the overflow pipe. The water pulled from the tank reservoir is in addition to the bleed water being supplied by the bleed outlet of the float actuated valve. The water flushing through the initiator tube effectively seals the air vent opening in the initiator tube so that no air can enter the syphon tube to prevent operation or break the vacuum to discontinue operation of the syphon tube.

Thus, for operation of the toilet during the partial flush mode, sufficient water is placed into the overflow pipe to fill the toilet bowl to the necessary pre-flush standing level so that subsequent flushes initiate the flushing function from the first of the water received by the toilet bowl.

When the float actuated valve closes (the float has risen to the pre-flush standing level in the toilet tank) and bleed water ceases issuing from the bleed outlet, the syphon tube ceases operation because air is now permitted to enter the syphon tube through the air vent hole in the initiator tube. Water is no longer supplied by the toilet tank to the toilet bowl and the toilet then sits waiting for the next operation, the toilet bowl standing water level now at the correct height.

Accordingly, it is an object of the present invention to provide a syphon device which increases water brought to the toilet bowl during the re-filling operation of the toilet tank to restore the water level in the toilet bowl to its proper standing level.

It is another object of the subject invention to provide a syphon device which transports water from the toilet tank to the toilet bowl during the toilet tank re-filling operation.

It is still another object of the subject invention to provide a syphon device which provides water from the toilet tank to the toilet bowl only during the time that the toilet tank is being re-filled.

Other objects of the subject invention will in part be obvious and will in part appear hereinafter. The invention accordingly comprises the apparatus possessing the construction, combination of elements, and arrangement of parts which are exemplified in the following detailed disclosure and the scope of the Application which will be indicated in the claims.

BRIEF DESCRIPTION OF THE DRAWINGS

For further understanding of the features and objects of the subject invention, reference should be had to the following detailed description taken in combination with the accompanying drawings wherein.

In various views, like index numbers refer to like elements.

DETAILED DESCRIPTION OF THE PREFERRED EMBODIMENT

Figure 1:
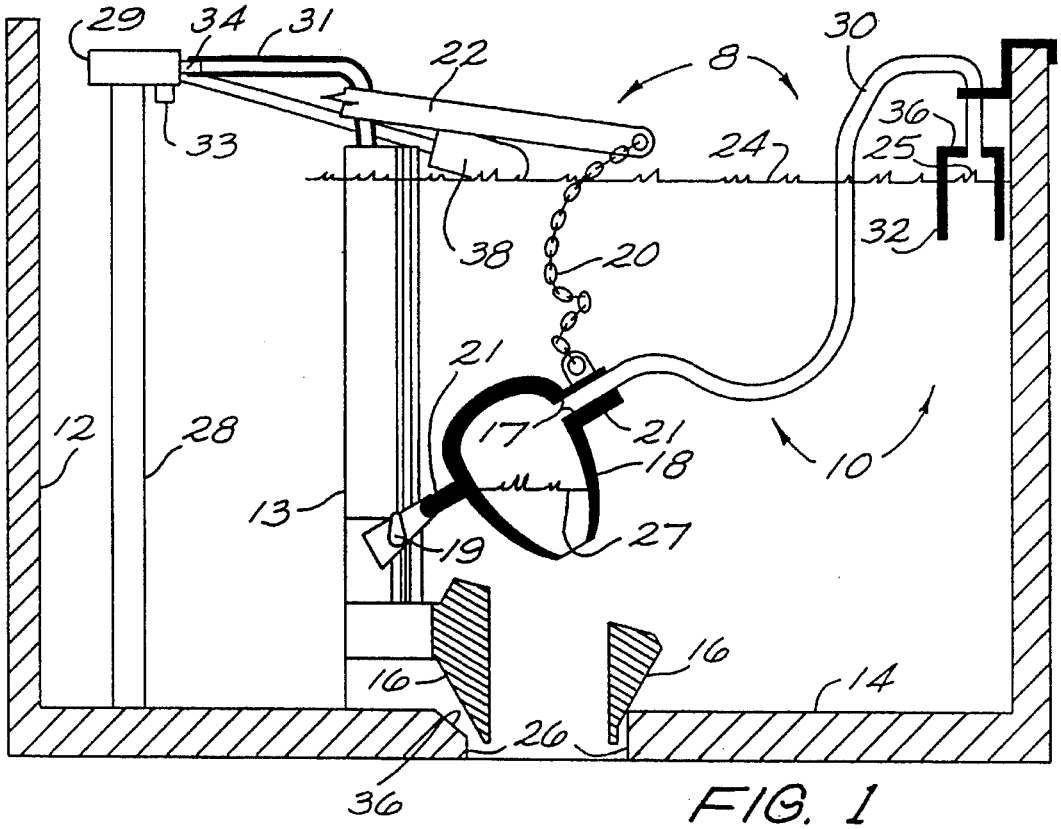
FIG. 1 PRIOR ART
FIG. 1 is a cross-sectional view of a typical prior art toilet reservoir tank with a "mini" or partial flush device in place.

Referring to FIG. 1, a cross-sectional view of prior art toilet water reservoir tank 8 illustrates an example of a "mini" or partial flush device 10. The particular partial flush device 10 shown in FIG. 1 is my previous invention, U.S. Pat. No. 5,228,144. To start a flush operation, the operator rotates the outside toilet flush handle downward (not shown). This causes lever 22 to begin to rotate upward. As the end of lever 22 rises upward, chain 20 attached at one end to lever 22 and at the other end to flapper valve 18 pulls on flapper valve 18. Since flapper valve 18 is pivotally attached to overflow pipe 13 by flapper valve hinge 19 and extension arm 21, it rotates of seat valve 16. Once lifted off seat valve 16 a sufficient distance to become fully buoyant in the water, flapper valve 18 continues to rise in the water in reservoir tank 8 (shown by water level 24) to a position well above seat valve 16. Flapper valve 18, buoyant due to air trapped inside its bell housing, then remains in such a position.

As water drains through the center opening of annular valve seat 16 and through outlet 26 in the bottom 14 of toilet water reservoir tank 8 into the toilet bowl (not shown), water level 24 begins to drop. As water level 24 drops, water level 25 within cylinder 32 of my prior invention also drops and air is pulled into the interior volume of cylinder 32 from the inside cavity of flapper valve 18 through opening 17 in the flapper valve and through flexible tubing 30. Cylinder 32 has an open bottom end and closed top end 36, the closed top end punctured by flexible tubing 30.

As air is withdrawn from the interior cavity of flapper valve 18, water enters the interior cavity through the bottom opening in the valve as shown by rising water level 27. When water level 25 within cylinder 32 has fallen sufficiently to withdraw enough air from the cavity of flapper valve 18 to render flapper valve 18 no longer buoyant, flapper valve 18 returns to valve seat 16 and terminates the flush. Since all of the water within reservoir tank 8 did not drain out, only a partial flush was effected. A partial flush is sufficient to rid the toilet bowl of liquid wastes and perhaps some solid wastes.

To effect a full flush, the operator only need to hold the toilet flush handle down (not shown), keeping lever 22 in an upraised position, thereby holding flapper valve up and preventing flapper valve 18 from returning to valve seat 16 to terminate the flush.

In continuing operation of the toilet of FIG. 1, as soon as water level 24 begins to fall, float actuated valve 29 begins to refill the tank with water. This is initiated by float 38 residing on the water surface, float 38 attached to float actuated valve 29 sensing the falling water level and causing float actuated valve 29 to open primary outlet 33. Water supplied float actuated valve 29 through water inlet pipe 28 begins to flow into reservoir tank 8. In addition, a lesser amount of water is diverted by the float actuated valve to bleed outlet 34 which discharges this water through flexible tubing 31 to overflow pipe 13. This bleed water runs down inside overflow pipe 13 and enters bottom tank outlet 26 by means of water passageway 36 formed in bottom 14 of reservoir tank 8, the water eventually ending up in the toilet bowl.

Thus, even while the toilet is in the process of being flushed, float actuated valve 29 is adding water to the tank and also sending water down the overflow pipe 13 into the bowl. However, water is being drained out of the tank faster than the water filling the tank. When a full flush or partial flush terminates by return of flapper valve 18 to valve seat 16, float actuated valve 29 continues to operate, dumping water both into the reservoir tank and into the overflow pipe 13. The water flowing into overflow pipe 13 continues into the toilet bowl where it brings the water level in the bowl up to the normal pre-flush level. If more water is introduced into the toilet bowl than is necessary to bring its water level up to the required pre-flush standing level, this excess water drains from the toilet bowl into the piping system to which the toilet is connected.

Lastly, as the incoming water fills tank 8 to its pre-flush level determined by float 38 attached to float actuated valve 29, the water flow terminates and the toilet sits ready for its next flush. Also, as the water rises in the toilet tank 8, water level 25 within cylinder 32 also rises and forces air from cylinder 32 into the cavity of flapper valve 18 where it is vented into outlet 26 and into the toilet bowl.

As previously mentioned, commonly during "mini" or partial flushes, insufficient water flows from bleed outlet 34 of float actuated valve 29 into overflow pipe 13 to bring the toilet bowl water level up to its normal pre-flush standing level. This situation happens because during a partial flush, float actuated valve 29 operates through a time cycle shorter than that for a full flush since only enough water is added to reservoir tank 8 to make up for that drained during the partial flush, rather than completely refilling reservoir tank 8 from a full flush. The result of a lower than normal water level in the bowl is that on the next flush, the first waters draining from reservoir tank into the toilet bowl is used to bring the toilet bowl water level up to its required height before the toilet can start its flushing action. As a consequence, insufficient water may be supplied during the partial flush to accomplish the goals of the partial flush.

Figure 2:
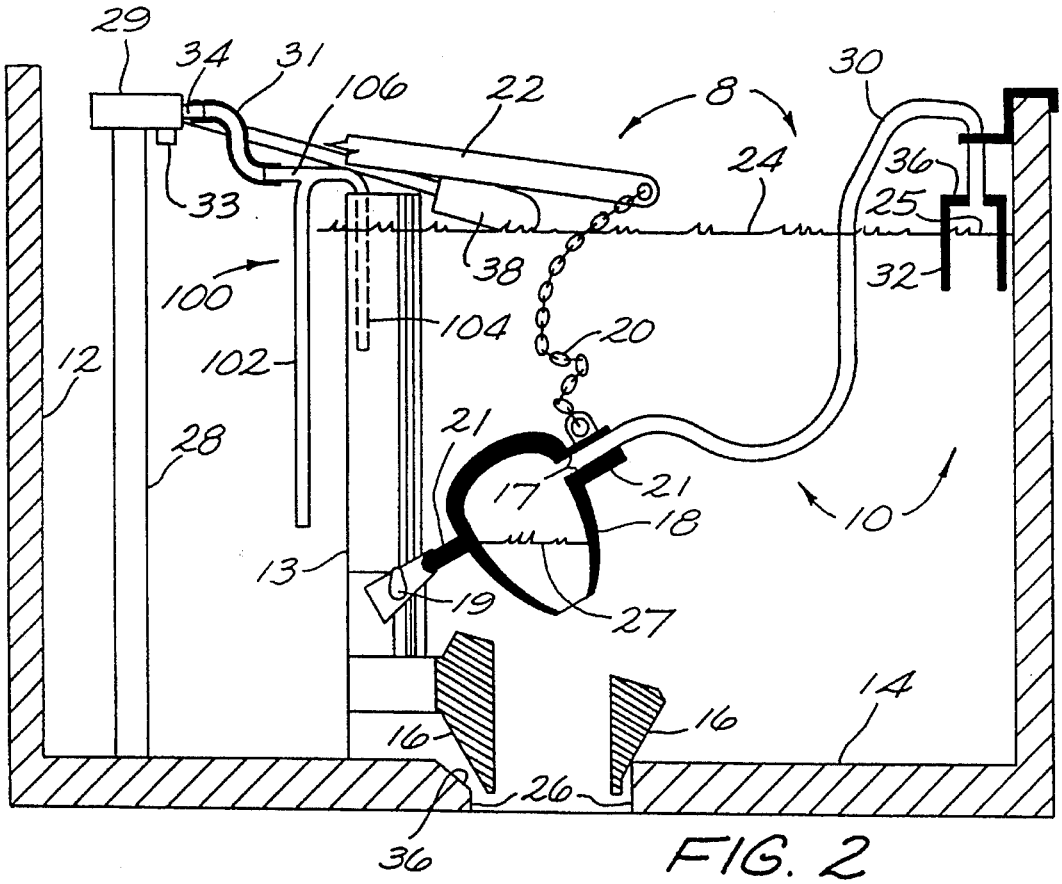
FIG. 2 is a cross-sectional view of a typical toilet reservoir tank with a "mini" or partial flush device in place together with the invention.

The problem of not transferring sufficient water into the toilet bowl to bring its level up to the pre-flush level is solved through the use of the invention shown in FIG. 2. More particularly, inventive syphon tube device 100 to assure a proper pre-flush water level in the toilet bowl is shown in a cross-sectional view. The device comprises an inverted "U" shaped syphon tube with one of its two parallel legs, namely shorter leg 104, protruding into overflow pipe 13. At the top rounded base portion 103 of the syphon tube is the syphon initiator tube 106, initiator tube 106 intersecting the syphon tube. Initiator tube 106 connects to the prior art flexible tubing 31, the other end of which still connected to bleed outlet 34 of float actuated valve Lastly, the second leg of syphon tube device 100, namely longer leg 102, dips down below the water to a level which assurably will be below the water level at which a partial flush terminates.

Syphon tube device 100 comprises, in the preferred embodiment, a plastic or metal, such as copper, hollow tube which has been formed into the shown "U" shape. Both ends are open. Initiator tube 106, preferably of a smaller inside diameter than the inside diameter of the short and long legs, is so arranged intersecting rounded base 103 that water injected into syphon device 100 from bleed outlet 34 of float actuated valve 29 (through flexible tubing 31 and initiator tube 106) flows into short leg 104 and down into overflow pipe 13 rather than running down long leg 102 and into reservoir tank 8. Not shown in FIG. 2, but shown in FIG. 3, is air vent opening 105 situated in initiator tube 106.

The device operates as follows. When float actuated valve 29 is discharging water into reservoir tank 8 because attached float 38 senses the water level in tank 8 has fallen below the standing level, the water which issues from bleed outlet 34 of valve 29 is conveyed to initiator tube 106 by flexible tube 31. This water, entering with some velocity, is directed by initiator tube 106 to the entrance of short leg 104, which acts to start the invention operating as a syphon. It is noted that while water is flowing through initiator tube 106 (from valve 29), the air vent opening in the top of the tube is effectively covered by the flowing incoming water so that no air may enter. In fact, a very small amount of water may escape through this opening. In the preferred embodiment, this air vent opening was in the order of 0.050 inches in diameter, the initiator tube had an inside diameter of 3/16 inches, and the syphon tube an inside diameter of 11/32 inches. It is realized of course that these dimensions may be varied with equally good results.

Syphon tube 100 pulls water from reservoir tank 8 through long leg 102 up into rounded base 103 and down through short leg 104 and into the overflow pipe 13. By such means, the volume of water introduced into overflow pipe 13 has been increased from the bleed water plus the volume of water brought up from reservoir tank 8. By such increased flow, the water level in the toilet bowl is returned to its pre-flush standing level in the much shorter period of time of the partial flush operation.

When the water level in reservoir tank 8 rises to its pre-flush level as determined by float 38, float actuated valve 29 closes and terminates water flowing out of primary outlet 33 and bleed outlet 34. This also stops the action of syphon tube 100 since the top most part of syphon tube 100 now is exposed to the air through the air vent opening at the top of the rounded base. Once air enters the top of syphon tube 100, its syphoning action terminates.

Figure 3A:
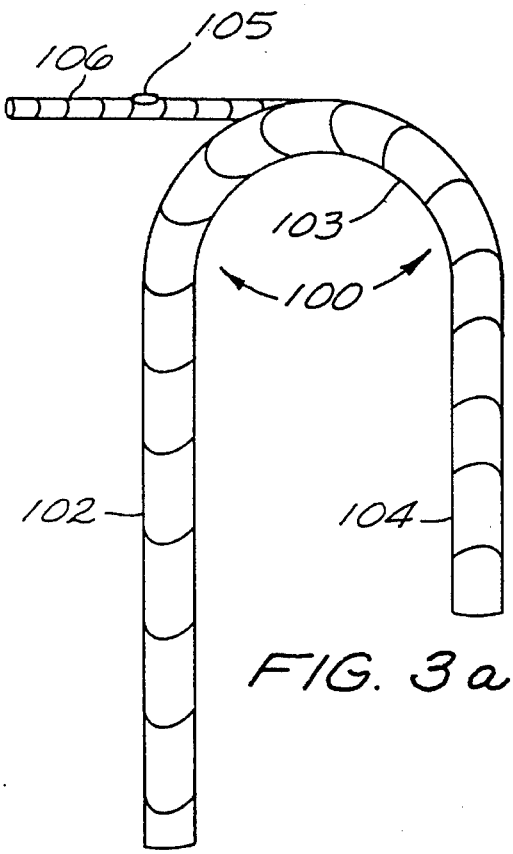
FIG. 3A is a perspective view of the subject invention prior to installation in a toilet tank.

Referring now to FIG. 3A, a perspective view of syphon tube 100 is shown whereby air vent opening 105 on the top surface of initiator tube 106 is clearly seen. It is noted that air vent opening 105 is situated on initiator tube 106 a sufficient distance from the open end of the tube such that flexible tubing 31 does not cover it. Also seen in FIG. 3 are long leg 102, short let 104, and rounded base 103 of syphon tube 100.

It is noted that with the position of air vent opening 105 shown in initiator tube 106, when water is flowing in initiator tube 106, air is prevented from entering syphon tube 100 since water effectively covers the opening. Possibly a small amount of water exits the air vent opening, even more prohibiting the introduction of air. In fact, even if the reverse were true, namely that air did enter initiator tube 106 through air vent opening 105 while water is passing through the tube, the water in initiator tube 106 so occupies the tube that insufficient air enters to prevent the syphon from operating.

Figure 3B:
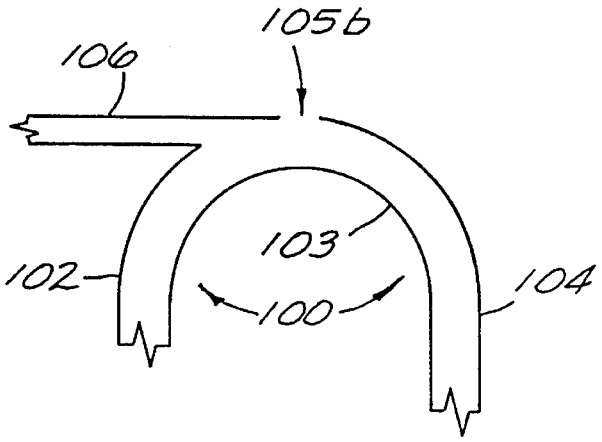
FIG. 3B is a partial cross-sectional view of an alternate embodiment of the invention.

An alternate embodiment of the invention is shown in FIG. 3B wherein the air vent opening 105*b* is shown in a partial cross-sectional view of syphon tube 100. With the air vent opening 105*b* in the rounded portion of the base, the opening must be so located in line with initiator tube 106 that water rushing into the grounded base portion from initiator tube 106 must cover this opening so that the vacuum interiorly to the syphon tube 100 is not broken during operation.

Figure 4:
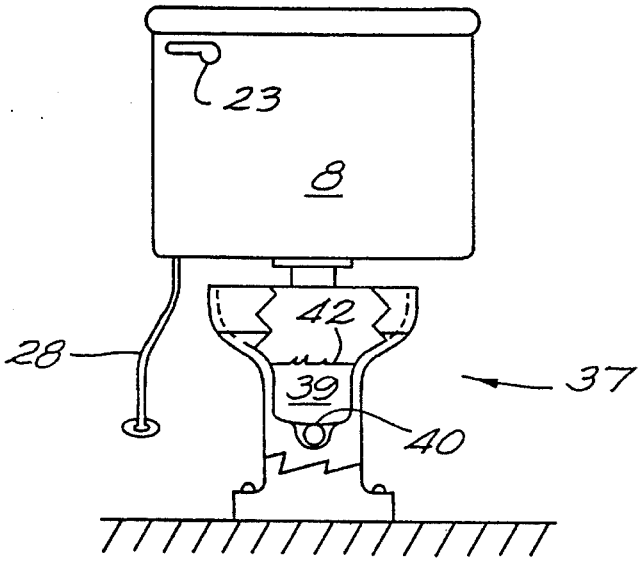
FIG. 4 is a front elevational view of a toilet assembly showing the toilet bowl in partial cross-section.

Lastly, shown in FIG. 4 is a front elevation view of a complete toilet assembly showing reservoir tank 8, outside flush handle 23 and water inlet pipe 28. In addition, toilet bowl 37 is shown in a partial broken away view to reveal toilet bowl water level 42 at its pre-flush standing level, the water residing in concave shaped cavity 39 of the toilet bowl. Water and waste materials are removed from toilet bowl 37 by means of opening 40 at the bottom of concave cavity 39.

While a preferred embodiment of the device, together with an alternate embodiment, has been shown and described, it will be understood that there is no intent to limit the invention by such disclosure, but rather it is intended to cover all modifications and alternate constructions falling within the spirit and the scope of the invention as defined in the appended claims.

I claim:

1. In a toilet assembly having a water holding toilet tank and a waste collecting toilet bowl operably connected to the toilet tank to receive water from the toilet tank so that when the toilet is flushed the wastes are carried away by the water, after which the connection is closed until the next flush, an overflow pipe and a float actuated valve located interiorly to the toilet tank, the overflow pipe also operably connected to the toilet bowl to convey water to the toilet bowl and the float actuated valve operating to supply water to the toilet when water beings draining from the toilet tank, the float actuated valve also having a bleed water outlet operably connected to the overflow pipe to convey bleed water to the toilet bowl during toilet tank refilling, an improvement to restore water in the toilet bowl to an optimum pre-flush standing level, said improvement comprising:

means to convey water from the toilet tank to the toilet bowl during refilling of the toilet tank in addition to that water supplied the toilet bowl by the bleed water outlet to bring the toilet bowl water level up to the optimum pre-flush standing level, said means including an elongated hollow "U" shaped syphon tube having a first leg and a second leg with interposed rounded portion, said first leg residing in the water in the toilet tank and said second leg residing interiorly to the overflow pipe, and further including an initiator tube of two ends, one end attached to said syphon tube rounded portion and the other end connected to the float actuated valve bleed water outlet, said initiator tube having an air vent opening therein, said air vent opening oriented upwards to minimize water leakage therefrom, the bleed water passing through said initiator tube, sealing said air vent opening, and entering said syphon tube rounded portion to cause water to be syphoned from the toilet tank into the overflow tube to increase the flow of water into the toilet bowl in order to reach the optimum pre-flush standing level prior to termination of the flush and when water ceases issuing from the bleed water outlet, air enters said air vent opening into said initiator tube and into said syphon tube to terminate operation of the syphon.

2. The device to restore the optimum pre-flush standing water level in the toilet bowl as defined in claim 1 wherein said initiator tube attached said syphon tube rounded portion is so situated that bleed water running through said initiator tube and into said rounded portion of said syphon tube is directed into said second leg of said syphon tube.

* * * * *